United States Patent [19]

Pinkas

[11] 4,330,250

[45] May 18, 1982

[54] PRESS DIAPHRAGM

[75] Inventor: Peter Pinkas, Kochel am See, Fed. Rep. of Germany

[73] Assignee: Dorst-Keramikmaschinen-Bau, Fed. Rep. of Germany

[21] Appl. No.: 174,733

[22] Filed: Aug. 4, 1980

[30] Foreign Application Priority Data

Aug. 16, 1979 [DE] Fed. Rep. of Germany ..... 2933226

[51] Int. Cl.[3] ..... B28B 7/06; B30B 11/02

[52] U.S. Cl. ..... 425/389; 264/314; 425/405 R; 425/DIG. 19

[58] Field of Search ..... 425/389, 405 R, 405 H, 425/DIG. 19; 264/71, 314

[56] References Cited

U.S. PATENT DOCUMENTS 3,520,961 7/1970 Suda et al. ..... 264/71

4,128,375 12/1978 Schubart ..... 425/389 X

FOREIGN PATENT DOCUMENTS 2627160 12/1977 Fed. Rep. of Germany .

*Primary Examiner*—Philip Anderson

*Attorney, Agent, or Firm*—Price, Heneveld, Huizenga & Cooper

[57] ABSTRACT

A press diaphragm for pressing china plates etc. has an edge part designed to be forced inwards on pressing and then to be moved back outwards on letting off the pressure clear of the plate edge. To this end the diaphragm has an edge part, acted upon by a downwardly moving keeper, and has a groove in its upper face. Under the groove the diaphragm is acted upon by hydraulic pressure more than at other positions.

5 Claims, 1 Drawing Figure

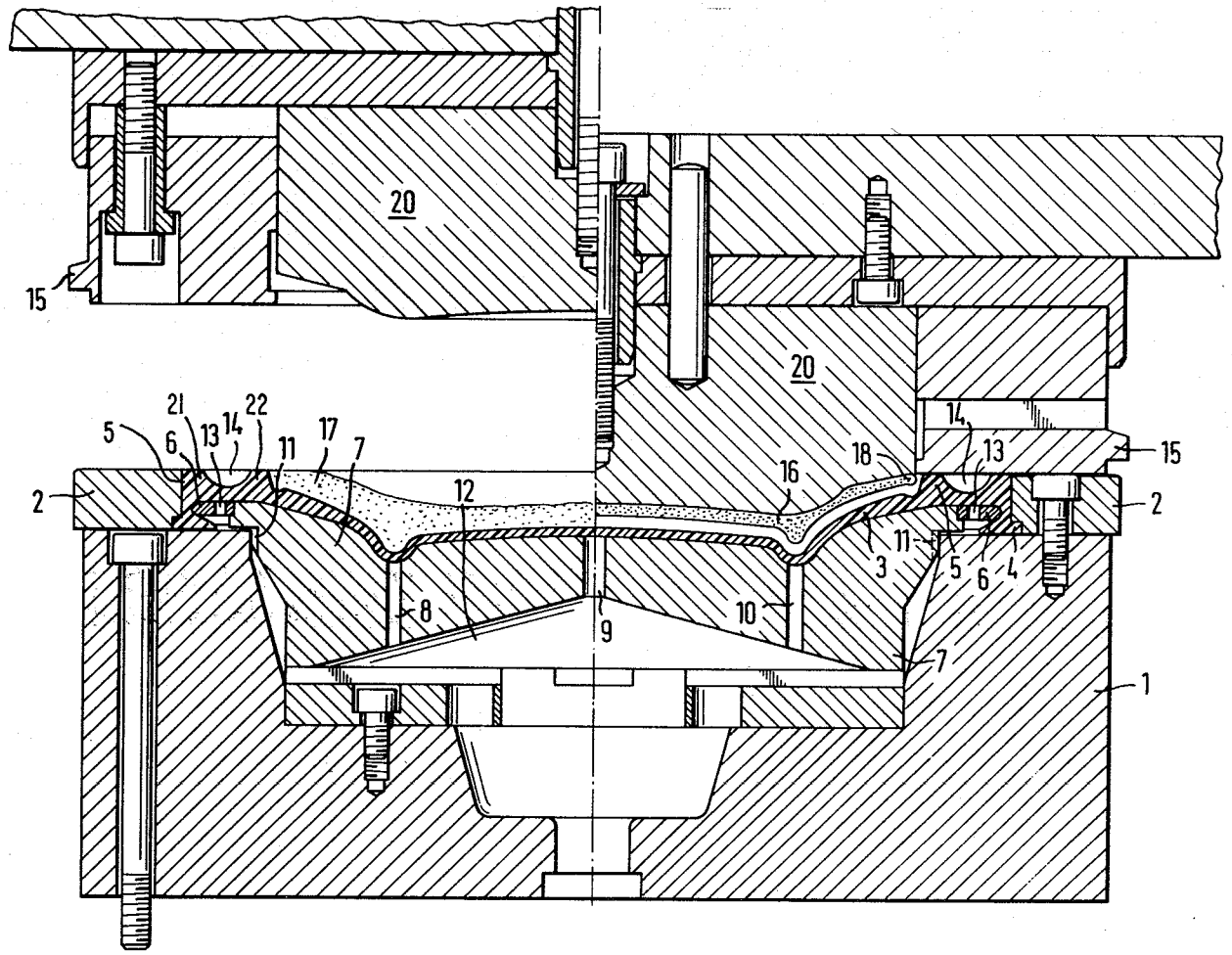
15
2
1
13
14
4
6
5
7
11
3
18
20
16
10
9
12
8
20
7
17
11
22
14
13
21
6
5
15
2

PRESS DIAPHRAGM

BACKGROUND OF THE INVENTION

The present invention is with respect to a diaphragm for a press for producing plates and other workpieces, having a rigid upper press ram, whose form is designed answering to the inner form of the workpiece to be pressed, and with a pressure medium cavity shut off at the top by the diaphragm, which, after the lowering of the press ram onto powder china material, with a powder distribution on the diaphragm within its limits as fixed by its supported edge, in the pressing position of the pressing ram, the cavity being in a form at whose edge the edge, having a hooked cross-section, of the diaphragm is fixedly kept in position by way of an inner part, running into the hooked cross-section, and a keeper ring which may be placed on this system and fixed against the mold edge.

A plate making press using such a diaphragm is to be seen for example in the German Auslegeschrift specification No. 2,627,160.

Plate workpieces as made with such a press have a pointed edge which is produced by pressing conditions and which has to be taken off using fettling tools so that the plate edge has the desired rounded form.

Such later processing was generally not possible in the case of plates with festooned edges, that is to say with an edge curving inwards and outwards round the plate.

The reason for the pointed or wedge-like edge is that the pressed plates, after the pressing operation, undergo an increase in size when the pressure is let off, with the outcome that the plate's outer diameter is increased so that, if the plate edge is gripped by the diaphragm or other press parts, it is much harder for the plate to be lifted upwards and it may be damaged on doing so. If, on the other hand, the plate edge is designed to be wedge-like, the forces which have to be overcome before the plates may be taken from the diaphragm are very much smaller, but however such wedge-like plate edges are undesired in the completed product and the edges have to be rounded off by fettling, much material being taken from the plate on doing this. In the case of a festooned edge, cutting material from the plate is generally not possible, more specifically in the inwardly curving parts so that plate presses which have so far been put forward are in need of further development in this respect.

SHORT OUTLINE OF THE INVENTION

One purpose of the invention is that of so designing the diaphragm in the edge part that a plate edge is produced which is only in need of a small amount of fettling, and more specially only wet fettling, without, however, the pressed plate being kept back by the diaphragm, after the top ram has run clear of it.

This purpose, and further purposes, are effected by the present invention in that the edge of the diaphragm has, on the face turned towards the top ram, an upwardly open ring groove, covered by the keeper ring and the system is designed so that the diaphragm is to be acted upon under this ring groove more than in other parts of it by the pressure medium.

Because of the ring groove it is possible for the edge to be changed in shape and moved inwards when the pressing operation takes place so that a round plate edge may be produced. If the pressing forces of the pressure medium come to an end, the edge of the diaphragm is moved back into its starting position or form, letting go of and clearing the rounded plate edge so that the plate may now be taken from the diaphragm without any danger of damage. The present invention has turned out to be more specially useful in the case of plates with a festooned edge, because in this case the special festooned form is formed by inwardly and outwardly curving parts so that only wet fettling is needed, something which is readily done.

More specially, in a further development of the invention, the inner part has pressure medium ways through its edge joined up with the pressure medium in the cavity.

In order to make it more readily possible for the diaphragm to be taken off and a new one put on in its place, as a further development of the invention, the edge of the inner part is designed as a separate and possibly many-part unit.

DETAILED ACCOUNT OF WORKING EXAMPLE OF INVENTION

A press with a diaphragm based on the teachings of the present invention will be seen in the FIGURE, in which the left hand part is a view of the press in the filling stage while the right hand side is a view of the press in the pressing stage after letting off the pressure medium pressure.

In the FIGURE the mold is numbered 1, and on it a keeper ring 2 is placed positioning the diaphragm 3 by way of an outwardly running key 4 in the form of a ring on the diaphragm. Futhermore the diaphragm 3 is fixedly positioned and supported at the edge 5 by the edge 6 of an inner rest 7, which has openings 8, 9 and 10 and cutouts 11 at the edge so that the pressure medium, present in the cavity 12, may be caused to take effect on the lower face of the diaphragm 3 itself. The edge of the inner rest 6 has pressure medium ways 13, joined by way of the through-holes 11 with the cavity 12. The diaphragm has at its edge an upwardly open ring groove 14 bordered by annular ridges 21 and 22. If the ring 15, joined with the top ram 20, is moved down onto the system made up of the ring 2, the edge 5 of the diaphragm 3 and the edge 6 of the inner rest 7, the diaphragm will be fixedly and safely positioned at the edge part so that, under the effect of the pressure medium on the lower face of the diaphragm of the plate, marked diagrammatically at 16, a plate will be molded from the china or porcelain material 17. When the pressure medium pressure comes into play it will more specially or preferentially go through the openings 13 and take effect on the lower face of the edge near the ring groove 14 so that the edge of the diaphragm will be curved upwards and inwards in this part and for this reason the rounded form 18 which is smooth and simple in design is produced. When the pressure is let off, the edge 5 of the diaphragm goes back into the form it had in the first place and for this reason the diaphragm part, placed within the ring groove 14 will be pulled outwards back clear of the plate edge 18 freeing the same.

I claim:

1. A press for producing plates and other workpieces having a rounded peripheral edge, said press having a rigid upper press ram of a form designed to shape the inner form of the workpiece to be pressed, a mold body having a central chamber, a flexible diaphragm closing the top of said chamber, a rigid seat for said diaphragm in said cavity, said diaphragm when seated on said seat providing a china powder material receiving mold chamber between it and said ram; said diaphragm having a peripheral flange and means securing the peripheral edge of said diaphragm to said mold body, said press characterized in that said peripheral flange has a pair of radially spaced upwardly extending annular ridges of a height greater than the thickness of the workpiece to be formed in the press when the press is closed, the inner face of the inner one of said ridges being upwardly and outwardly inclined when said press is open; an annular upwardly opening concave channel between said ridges, the upper face of said diaphragm at the base of said inner face of the inner of said ridges having a shallow annular concavity of rounded cross-section; conduit means communicating from the base of said peripheral flange intermediate said ridges for introducing fluid under pressure from said chamber to arch the bottom of said channel upwardly and in cooperation with the downward pressure of said ram on said ridges to force the top of the inner ridge to curve inwardly to form, in cooperation with said annular concavity, a rounded edge on the workpiece press formed therein.

2. The press described in claim 1 further characterized in that said annular channel is arcuate in cross section.

3. The press described in claim 1 further characterized in that the diaphragm seat has a peripheral ring surrounding and secured thereto, a portion of the peripheral edge of said diaphragm seating around and under the edge of said ring; said ring having openings therethrough forming part of said conduit means.

4. The press described in claim 3 further characterized in that said diaphragm seat has a radially extending peripheral lip forming a recess opening through the edge and top of said seat for receiving said ring therein, said lip forming a fluid passage beneath said ring forming a part of said conduit.

5. The press described in either claims 3 or 4 further characterized in that said annular channel is arcuate in cross section.

* * * * *